US005992124A

United States Patent [19]

Robinson

[11] Patent Number: 5,992,124

[45] Date of Patent: Nov. 30, 1999

[54] PILASTER MOUNTING SYSTEM AND CEILING SHOE

[75] Inventor: Kirk R. Robinson, Susquehana, Pa.

[73] Assignee: Santana Products, Inc., Scranton, Pa.

[21] Appl. No.: 09/044,988

[22] Filed: Mar. 20, 1998

[51] Int. Cl.[6] ..... E04C 3/36

[52] U.S. Cl. ..... 52/721.4; 52/239; 52/243; 52/721.5; 52/723.2; 52/736.4; 52/737.5

[58] Field of Search ..... 52/736.4, 721.4, 52/239, 35, 34, 243, 737.5, 723.2, 721.5; 403/340

[56] References Cited

U.S. PATENT DOCUMENTS

| | | | |
|---|---|---|---|
| 1,272,131 | 7/1918 | Silberg | 403/340 X |
| 1,278,895 | 9/1918 | Farley | 403/340 X |
| 1,954,845 | 4/1934 | Schille | 52/721.4 X |
| 3,108,664 | 10/1963 | Vawter | 52/736.4 X |
| 3,194,362 | 7/1965 | Wargo | 52/736.4 X |
| 3,489,392 | 1/1970 | Thom | 403/340 X |
| 3,999,353 | 12/1976 | Dielman | 52/736.4 X |

*Primary Examiner*—Christopher T. Kent

*Attorney, Agent, or Firm*—Larson & Taylor

[57] ABSTRACT

A ceiling shoe and pilaster mounting system for a ceiling, where the pilaster mounting system includes a pilaster which is attached to a ceiling bracket which in turn is attached to the ceiling. The pilaster ceiling shoe is used to cover the top end of the pilaster and the ceiling bracket up to the ceiling. This ceiling shoe includes front and back shoe halves which are identical and mated together. Each shoe half has (a) a planar main wall which is oriented vertically, (b) a first side which is oriented vertically and which has a free vertical inner flange which is stepped inwardly from a remainder of the first side leaving an outer cutout, and (c) a second side which is oriented vertically and which has a free vertical outer flange which is stepped outwardly from a remainder of the second side leaving an inner cutout. The front shoe half and the back shoe half are then attached to the top end of the pilaster so that the first and second shoe halves are mated together to form the ceiling shoe (a) with the inner flange of the front shoe half horizontally adjacent the outer flange of the back shoe half, (b) with the outer flange of the front shoe half horizontally adjacent the inner flange of the back shoe half, and (c) with the top edges of the front and back shoe halves immediately adjacent the ceiling.

12 Claims, 3 Drawing Sheets

PILASTER MOUNTING SYSTEM AND CEILING SHOE

FIELD OF THE INVENTION

The present invention relates generally to the mounting of pilasters to a ceiling, and more particularly to a ceiling mounted pilaster with a pilaster ceiling shoe which covers a top portion of the pilaster.

BACKGROUND OF THE INVENTION

Ceiling mounted pilasters are used in a variety of structures, such as for restroom stalls and the like. Such pilasters are routinely mounted to brackets attached to the ceiling, or without a bracket directly to the ceiling itself (or a support or beam provided immediately above the ceiling). Where the pilaster is attached directly to the ceiling, stainless steel shoes have been provided about the top portion of each pilaster for aesthetic reasons. Such shoes are tubular, and are placed on the pilaster prior to attachment of the pilaster to the ceiling. The shoe is made slightly larger than the cross section of the pilaster so that the shoe is slidable therealong. Thus, after being slid onto the pilaster, the pilaster is attached to the ceiling with the shoe slid out of the way. Subsequently, the shoe is moved into place along the pilaster to the top portion thereof with the shoe touching or immediately adjacent the ceiling. The shoe is then mounted in this position to hide the attachment mechanism and ceiling hole or the like. Typically, the shoe is held in place by driving a screw through one face thereof provided with a hole and into the pilaster underneath.

Unfortunately, problems have arisen with the prior art tubular shoes. During installation of the stalls or the like, installers will forget to place the shoes on the pilasters prior to attachment of the pilaster to the ceiling and associated elements of the stall. When this occurs, it is often not recognized that an error in installation has occurred until after a number of pilasters are attached to the ceiling. At that time, each pilaster must then be individually disengaged from the ceiling sufficiently to allow a shoe to be slid thereon, and then the pilaster must be reattached to the ceiling. This remedial action is both time consuming and sometimes difficult where other elements are already attached to the pilaster which must be disengaged from the ceiling.

SUMMARY OF THE INVENTION

In accordance with the present invention, a pilaster ceiling shoe and a pilaster mounting system for a ceiling are provided. The pilaster mounting system includes a pilaster having a top end and a bottom end. A first attaching means is then used for attaching a ceiling bracket to the top end of the pilaster, and a second attaching means is used for attaching the ceiling bracket to the ceiling. Thereafter, a pilaster ceiling shoe for covering the top end of the pilaster and the ceiling bracket up to the ceiling is located about the pilaster. This ceiling shoe comprises front and back shoe halves which are identical and mated together. In particular, each the shoe half has (a) a planar main wall which is oriented vertically, the main wall having a top edge, a bottom edge, a left end and a right end, (b) a first side which is oriented vertically and which extends perpendicularly in a first direction from one of the left end and right end of the main wall, the first side having a free vertical inner flange which is stepped inwardly from a remainder of the first side leaving an outer cutout, and (c) a second side which is oriented vertically and which extends perpendicularly in the first direction from the other one of the left end and right end of the main wall, the second side having a free vertical outer flange which is stepped outwardly from a remainder of the second side leaving an inner cutout.

The pilaster mounting system then further includes a third attaching means which attaches the front shoe half and the back shoe half to the top end of the pilaster. When this occurs, the first and second shoe halves are mated together to form the ceiling shoe (a) with the inner flange of the front shoe half horizontally adjacent the outer flange of the back shoe half such that the inner flange of the front shoe half fills the inner cutout of the back shoe half and the outer flange of the back shoe half fills the outer cutout of the front shoe half, (b) with the outer flange of the front shoe half horizontally adjacent the inner flange of the back shoe half such that the outer flange of the front shoe half fills the outer cutout of the back shoe half and the inner flange of the back shoe half fills the inner cutout of the front shoe half, and (c) with the top edges of the front and back shoe halves immediately adjacent the ceiling.

In accordance with a preferred embodiment, the first side of each shoe half joins the one of the left end and right end of the main wall with a first inside corner and a first outside corner, both of which the first corners are equally radiused. In addition, the second side of each the shoe half joins the other one of the left end and right end of the main wall with a second inside corner and a second outside corner, both of which the second corners are equally radiused the same as the first corners.

In the preferred embodiment, the main wall of each shoe half has a thickness, and the inner flanges and the outer flanges of each shoe half have a thickness equal to that of the main wall. In addition, the front and back shoe halves are made of injected molded high density polyethylene, the pilaster is made of extruded and compression molded high density polyethylene, and the third attaching means are two screws extending respectively through respective mating first and second sides of the front shoe half and the back shoe half, and into the pilaster.

It is an advantage of the present invention that a ceiling shoe is provided which is easily and quickly attached about the top portion of a ceiling hung pilaster.

It is also an advantage of the present invention that the ceiling shoe is attachable at any time to the pilaster, and in particular after the pilaster is attached to the ceiling without any prior action needed.

It is still another advantage of the present invention that a ceiling shoe is provided which is cheaply and easily made of a plastic material.

Other features and advantages of the present invention are stated in or apparent from detailed descriptions of presently preferred embodiments of the invention found hereinbelow.

DESCRIPTION OF THE PREFERRED EMBODIMENTS

Figure 2:
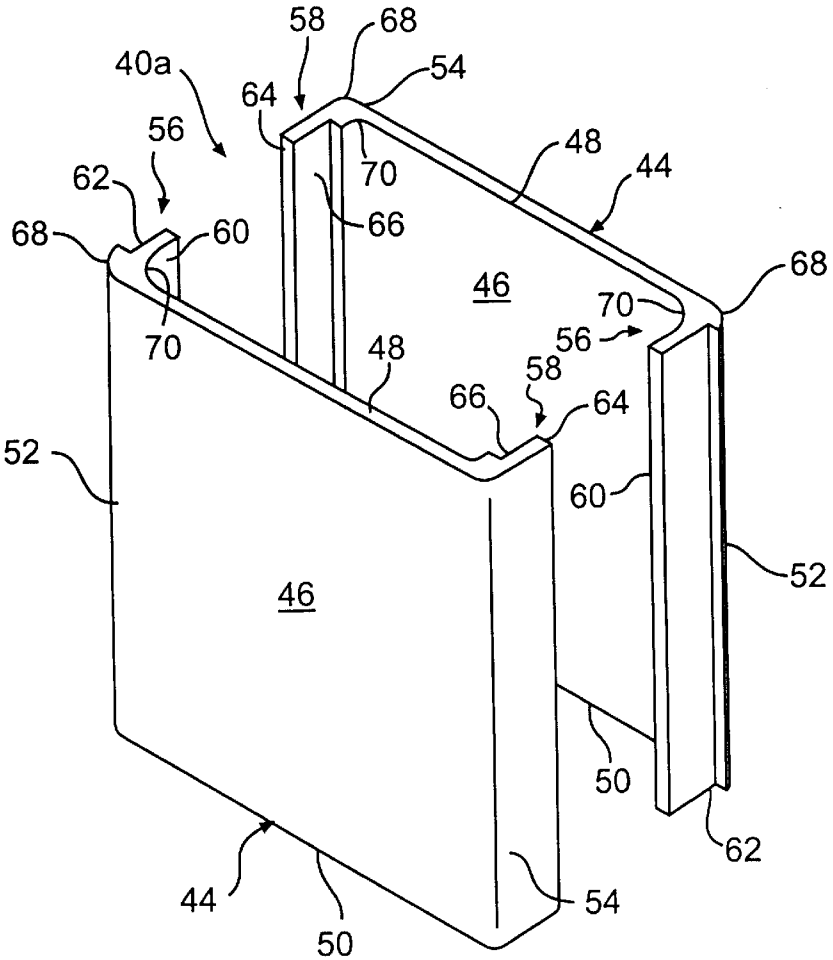
FIG. 2 is a top, front and side perspective view of a pilaster ceiling shoe of the present invention which is depicted in FIG. 1.
Figure 1:
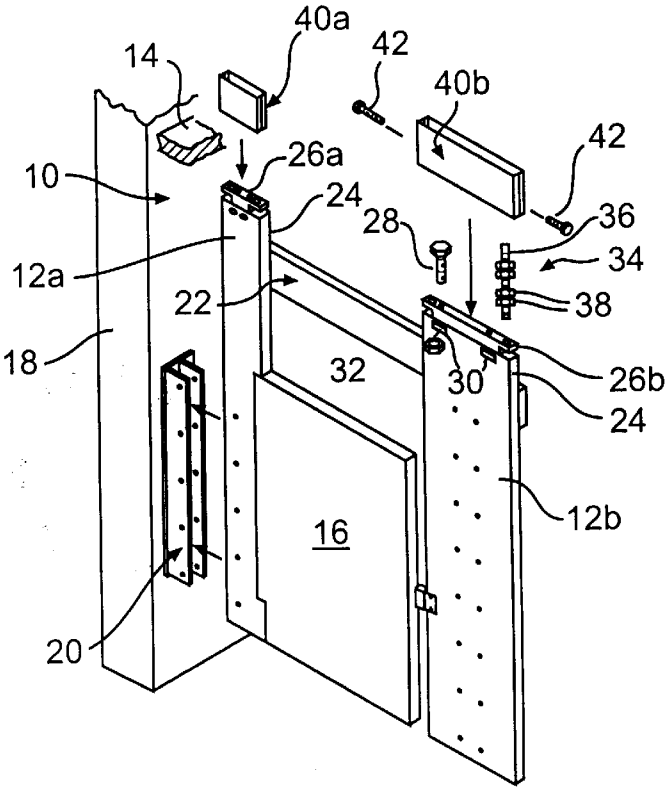
FIG. 1 is a schematic top, front and side perspective view of the pilaster mounting system and pilaster ceiling shoe of the present invention.
Figure 4:
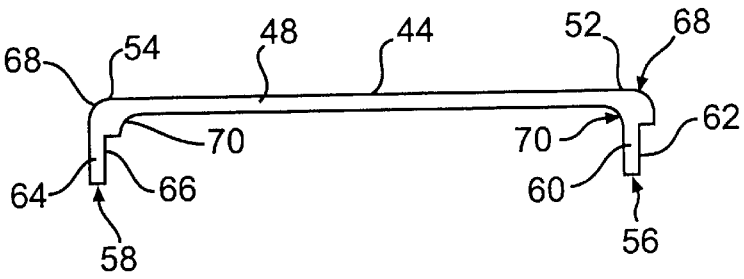
FIG. 4 is a top plan view of a shoe half of the ceiling shoe depicted in FIG. 2.
Figure 3:
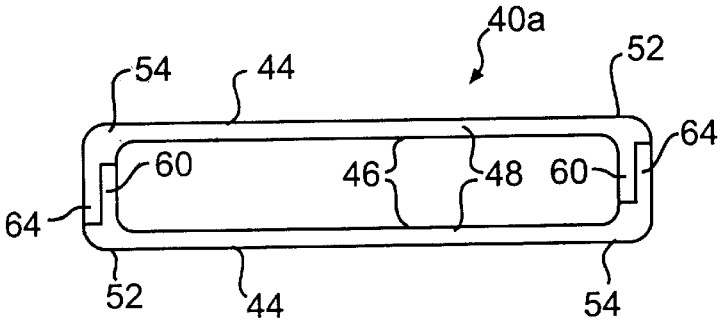
FIG. 3 is a top plan view of the ceiling shoe depicted in FIG. 2.
Figure 6:
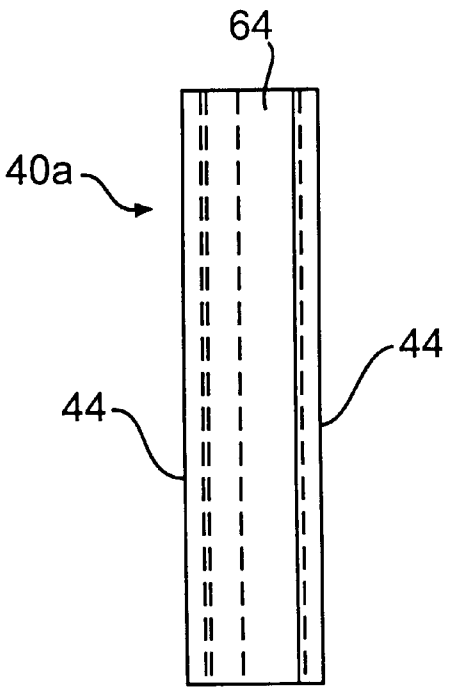
FIG. 6 is a right side elevation view of the ceiling shoe depicted in FIG. 2.
Figure 5:
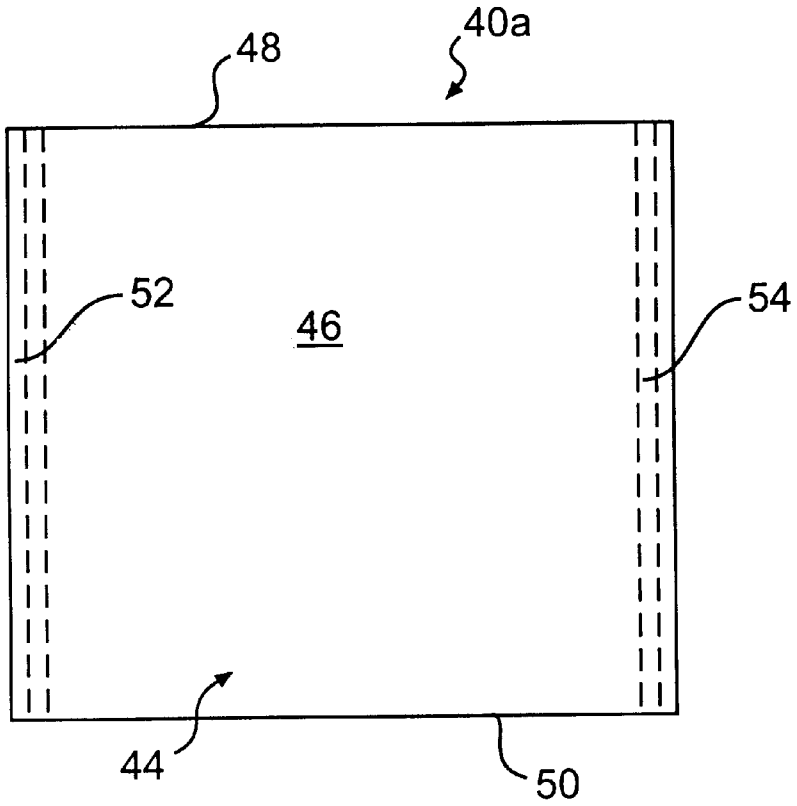
FIG. 5 is a front elevation view of the ceiling shoe depicted FIG. 2.

With reference now to the drawings in which like numerals represent like elements throughout the views, a pilaster mounting system 10 is depicted in FIG. 1 by which pilasters 12*a* and 12*b* are mounted to a ceiling 14 (only a small portion of which is shown for clarity). Typically, pilasters 12 are part of a restroom stall or the like, and in the depicted embodiment, pilasters 12 form part of a door frame for a door 16 hinged to pilaster 12*a* and which strikes pilaster 12*b* as known in the art. In this embodiment, pilaster 12*a* is also attached to a wall 18 using a U-shaped bracket 20 and suitable screws (not shown). A cross brace 22 is also depicted which is typically used.

Pilasters 12 in this preferred embodiment are made of an extruded and compresssion molded high density polyethylene and may be suitably dyed to be any desired color as known in the art. At a top end 24 of each pilaster 12*a* and 12*b*, a ceiling bracket 26*a* or 26*b* is attached using bolts 28 (only one of which is shown) which pass through ceiling bracket 26 and which end at slots 30 in top ends 24 in which nuts 32 (only one of which is shown) are located. Using bolts 28 and nuts 32, ceiling brackets 26*a* and 26*b* are tightly secured to top ends 24 of pilasters 12*a* and 12*b* as known in the art.

In order to secure ceiling brackets 26 to ceiling 14, an attaching means 34 is used as also known in the art. Attaching means 34 is conveniently a ⅜" threaded rod 36 having two pairs of nuts 38 provided thereon. One pair of nuts 38 is used to attach a respective side of ceiling bracket 26 therebetween. Then, the other pair of nuts 38 is used to attach ceiling 14 (or a support such as an I beam immediately thereabove) therebetween, and thus to attach pilaster 12 to ceiling 14.

The attachment of pilaster 12*a* or 12*b* to ceiling 14 may be unsightly, or at least not aesthetically pleasing. In addition, it is usually desirous to render inaccessible attaching means 34 so that no mischief or vandalism will result in pilasters 12 falling from ceiling 14. In order to accomplish these objectives, ceiling shoes 40*a* and 40*b* are attached about top ends 24 of pilasters 12*a* and 12*b* in contact with ceiling 14 using suitable one-way screws 42 as discussed subsequently.

Ceiling shoes 40*a* and 40*b* are substantially identical, except for the width of pilaster 12*a* or 12*b* to be located therebetween (note, the thickness could also vary). Therefore, the specific constructions of ceiling shoes 40*a* and 40*b* will be discussed with reference only to ceiling shoe 40*a* depicted in FIGS. 2–6.

As shown in FIGS. 2–6, ceiling shoe 40*a* is formed of identical front and back shoe halves 44 which are preferably made of injection molded high density polyethylene (the front and back designation thus being arbitrary and used only for convenience of description following the locations in the figures). Each shoe half 44 has a main wall 46 which is to be oriented vertically as shown in FIG. 1. Main wall 46 is considered (arbitrarily, as shoe halves can be oriented opposite to that shown) to have a top edge 48, a bottom edge 50, a left end 52 and a right end 54. Each shoe half 44 also has a first side 56 and a second side 58, both of which are also arbitrarily designated and oriented vertically as shown in FIG. 1.

First side 56 extends perpendicularly toward the mating shoe half 44 from one side end of shoe half 44 which has arbitrarily been designated left end 52. First side 56 has a free vertical inner flange 60 which is stepped inwardly from a remainder of first side 56 leaving an outer cutout 62 as shown. In a similar and complementary manner, second side 58 extends perpendicularly toward the mating shoe half 44 from the other side end of shoe half 44 which has arbitrarily been designated right end 54, and second side 58 has a free vertical outer flange 64 which is stepped outwardly from a remainder of second side 58 leaving an inner cutout 66 as shown. Where first side 56 and second side 58 join main wall 46 there are outside corners 68 and inside corners 70, all of which are equally radiused at 0.25" in the preferred embodiment. It will also be appreciated that main wall 56 has a wall thickness of 0.19" which is equal to the wall thicknesses of inner flange 60 and/or outer flange 64 (and hence of cutouts 62 and 66 as well).

With this construction of shoe halves 44, it will be appreciated that it is a simple matter to mate the two shoe halves 44 together at top end 24 of pilaster 12*a* with top edges 48 in contact or immediately adjacent ceiling 14. This mating occurs, as shown best in FIG. 3, with inner flange 60 of front shoe half 44 horizontally adjacent outer flange 64 of back shoe half 44 such that inner flange 60 of front shoe half 44 fills inner cutout 66 of back shoe half 44 and outer flange 64 of back shoe half 44 fills outer cutout 62 of front shoe half 44. Similarly on the other side, outer flange 64 of front shoe half 44 is horizontally adjacent inner flange 60 of back shoe half 44 such that outer flange 64 of front shoe half 44 fills outer cutout 62 of back shoe half 44 and inner flange 60 of back shoe half 44 fills inner cutout 66 of front shoe half 44.

Mated shoe halves 44 are held in position by use of one-way screws 42 as noted above. Preferably, screws 42 are positioned to pass through both inner flange 60 and outer flange 64 and then into pilaster 12 (or into ceiling bracket 26). This can be accomplished using pre-drilled holes (not shown), if desired; or by simply driving screws 42 first into shoe halves 44 and then into the underlying pilaster 12. Alternately, screws 42 can be simply driven through main wall 46 of each shoe half 44 and into pilaster 12. Obviously, other attaching means know in the art such as glues or the like are possible.

With ceiling shoes 40*a* and 40*b* in place on pilasters 12*a* and 12*b*, an aesthetically pleasing appearance is provided at the top of pilasters 12*a* and 12*b*. In addition, attaching means 34 is then hidden from view and from tampering.

While the present invention has been described with respect to an exemplary embodiment thereof, it will be understood by those of ordinary skill in the art that variations and modifications can be effected within the scope and spirit of the invention.

I claim:

1. A pilaster ceiling shoe for covering a ceiling portion of a vertically oriented pilaster comprising:

front and back shoe halves which are identical, each said shoe half having a planar main wall which is oriented vertically, said main wall having a top edge, a bottom edge, a left end and a right end, a first side which is oriented vertically and which extends perpendicularly in a first direction from one of said left end and right end of said main wall for a predetermined distance, said first side having a free vertical inner flange which is stepped inwardly from a remainder of said first side leaving an outer cutout, and a second side which is oriented vertically and which extends perpendicularly in the first direction from the other one of said left end and right end of said main wall for the predetermined distance, said second side having a free vertical outer flange which is stepped outwardly from a remainder of said second side leaving an inner cutout, wherein said first and second shoe halves are mated together to form said ceiling shoe with (a) said inner flange of said front shoe half horizontally adjacent said outer flange of said back shoe half such that said inner flange of said front shoe half fills said inner cutout of said back shoe half and said outer flange of said back shoe half fills said outer cutout of said front shoe half, and (b) said outer flange of said front shoe half horizontally adjacent said inner flange of said back shoe half such that said outer flange of said front shoe half fills said inner cutout of said back shoe half and said inner flange of said back shoe half fills said inner cutout of said front shoe half.

2. A pilaster ceiling shoe as claimed in claim 1:

wherein said first side joins said one of said left end and right end of said main wall with a first inside corner and a first outside corner, both of which said first corners are equally radiused;

wherein said second side joins said other one of said left end and right end of said main wall with a second inside corner and a second outside corner, both of which said second corners are equally radiused with said first corners.

3. A pilaster ceiling shoe as claimed in claim 1:

wherein said inner and outer flanges of each of said shoe halves have substantially constant and equal thicknesses along the first direction; and wherein each said shoe half has a thickness of said main wall which is equal to the thickness of said inner flange and the thickness of said outer flange.

4. A pilaster ceiling shoe as claimed in claim 1 wherein said front and back shoe halves are made of injection molded high density polyethylene.

5. A pilaster ceiling shoe as claimed in claim 4:

wherein said first side joins said one of said left end and right end of said main wall with a first inside corner and a first outside corner, both of which said first corners are equally radiused;

wherein said second side joins said other one of said left end and right end of said main wall with a second inside corner and a second outside corner, both of which said second corners are equally radiused with said first corners.

6. A pilaster ceiling shoe as claimed in claim 5:

wherein said inner and outer flanges of each of said shoe halves have substantially constant and equal thicknesses along the first direction: and wherein each said shoe half has a thickness of said main wall which is equal to the thickness of said inner flange and the thickness of said outer flange.

7. A pilaster mounting system for a ceiling comprising:

a pilaster having a top end and a bottom end;

a ceiling bracket;

a first attaching means for attaching said ceiling bracket to the top end of said pilaster;

a second attaching means for attaching said ceiling bracket to the ceiling;

a pilaster ceiling shoe for covering the top end of said pilaster and said ceiling bracket up to the ceiling, said ceiling shoe comprising front and back shoe halves which are identical, each said shoe half having a planar main wall which is oriented vertically, said main wall having a top edge, a bottom edge, a left end and a right end, a first side which is oriented vertically and which extends perpendicularly in a first direction from one of said left end and right end of said main wall for a predetermined distance, said first side having a free vertical inner flange which is stepped inwardly from a remainder of said first side leaving an outer cutout, and a second side which is oriented vertically and which extends perpendicularly in the first direction from the other one of said left end and right end of said main wall for the predetermined distance, said second side having a free vertical outer flange which is stepped outwardly from a remainder of said second side leaving an inner cutout; and a third attaching means for attaching said front shoe half and said back shoe half to the top end of said pilaster wherein said first and second shoe halves are mated together to form said ceiling shoe (a) with said inner flange of said front shoe half horizontally adjacent said outer flange of said back shoe half such that said inner flange of said front shoe half fills said inner cutout of said back shoe half and said outer flange of said back shoe half fills said outer cutout of said front shoe half, (b) with said outer flange of said front half horizontally adjacent said inner flange of said back shoe half such that said outer flange of said front shoe half fills said inner cutout of said back shoe half and said inner flange of said back shoe half fills said inner cutout of said front shoe half, and (c) with said top edges of said front and back shoe halves immediately adjacent the ceiling.

8. A pilaster mounting system as claimed in claim 7:

wherein said first side of each said shoe half joins said one of said left end and right end of said main wall with a first inside corner and a first outside corner, both of which said first corners are equally radiused;

wherein said second side of each said shoe half joins said other one of said left end and right end of said main wall with a second inside corner and a second outside corner, both of which said second corners are equally radiused with said first corners.

9. A pilaster ceiling shoe as claimed in claim 7:

wherein said inner and outer flanges of each of said shoe halves have substantially constant and equal thicknesses along the first direction; and wherein each said shoe half has a thickness of said main wall which is equal to the thickness of said inner flange and the thickness of said outer flange.

10. A pilaster ceiling shoe as claimed in claim 7;

wherein said front and back shoe halves are made of injection molded high density polyethylene;

wherein said pilaster is made of extruded and compression molded high density polyethylene; and wherein said third attaching means are two screws extending respectively through respective mating said first and second sides of said front shoe half and said back shoe half, and into said pilaster.

11. A pilaster ceiling shoe as claimed in claim 10:

wherein said first side of each said shoe half joins said one of said left end and right end of said main wall with a first inside corner and a first outside corner, both of which said first corners are equally radiused;

wherein said second side of each said shoe half joins said other one of said left end and right end of said main wall with a second inside corner and a second outside corner, both of which said second corners are equally radiused with said first corners.

12. A pilaster ceiling shoe as claimed in claim 11:

wherein said inner and outer flanges of each of said shoe halves have substantially constant and equal thicknesses along the first direction; and wherein each said shoe half has a thickness of said main wall which is equal to the thickness of said inner flange and the thickness of said outer flange.

* * * * *